US008745821B2

(12) United States Patent
Chang et al.

(10) Patent No.: US 8,745,821 B2
(45) **Date of Patent: *Jun. 10, 2014**

(54) AUTO-CLOSING DEVICE FOR A SLIDING DOOR

(71) Applicant: Door & Window Hardware Co., Taichung (TW)

(72) Inventors: Wei-Hung Chang, Taichung (TW); Sung-Hui Lin, Taichung (TW)

(73) Assignee: Door & Window Hardware Co., Taichung (TW)

( * ) Notice: Subject to any disclaimer, the term of this patent is extended or adjusted under 35 U.S.C. 154(b) by 59 days.

This patent is subject to a terminal disclaimer.

(21) Appl. No.: 13/659,348

(22) Filed: Oct. 24, 2012

(65) Prior Publication Data

US 2014/0109343 A1 Apr. 24, 2014

(51) Int. Cl.
*E05F 1/00* (2006.01)
*E05F 5/00* (2006.01)

(52) U.S. Cl.
CPC ..... *E05F 5/003* (2013.01)
USPC ..... 16/71; 16/49; 16/82; 49/409

(58) Field of Classification Search
CPC ..... E05F 5/003
USPC ..... 16/71, 72, 82, 83, 84, 49, 51, 66, 70, 16/65, 96 R; 49/414, 417, 409
See application file for complete search history.

(56) References Cited

U.S. PATENT DOCUMENTS

| | | | | | |
|---|---|---|---|---|---|
| 4,004,372 | A * | 1/1977 | Beard et al. | 49/404 |
| 4,590,639 | A * | 5/1986 | Fritsche et al. | 16/79 |
| 4,686,739 | A * | 8/1987 | Fritsche et al. | 16/79 |
| 4,785,493 | A * | 11/1988 | Tillmann et al. | 16/53 |
| 5,207,781 | A * | 5/1993 | Rock | 312/319.1 |
| 5,251,402 | A * | 10/1993 | Richardson et al. | 49/404 |
| 5,659,999 | A * | 8/1997 | Benson | 49/404 |
| 6,848,759 | B2 * | 2/2005 | Doornbos et al. | 312/319.1 |
| 7,210,198 | B2 * | 5/2007 | Hoshide et al. | 16/96 R |
| 7,743,464 | B2 * | 6/2010 | Tomioka et al. | 16/64 |
| 7,945,993 | B2 * | 5/2011 | Tomioka et al. | 16/64 |
| 8,307,497 | B2 * | 11/2012 | Chang et al. | 16/71 |
| 2001/0008037 | A1 * | 7/2001 | Brustle | 16/71 |
| 2003/0189395 | A1 * | 10/2003 | Doornbos et al. | 312/334.1 |
| 2011/0191981 | A1 * | 8/2011 | Bell | 16/72 |
| 2013/0182978 | A1 * | 7/2013 | Huang | 384/21 |

* cited by examiner

*Primary Examiner* — Jeffrey O Brien
(74) *Attorney, Agent, or Firm* — Muncy, Geissler, Olds & Lowe, P.C.

(57) ABSTRACT

An auto-closing device has a base, a cylinder, a slider, a spring and an adjusting device. The adjusting device is connected to an end of the spring opposite to the slider and has an adjusting frame and an adjusting bolt. The adjusting frame has a first end connected securely to the spring and a second end provided with a threaded hole. The adjusting bolt is mounted rotatably on the base and is screwed into the threaded hole in the adjusting frame. Accordingly, when the adjusting bolt is rotated, the adjusting frame is moved relative to the body so that the pulling force provided by the spring is adjusted to fit with different door panels with different weights.

12 Claims, 6 Drawing Sheets

AUTO-CLOSING DEVICE FOR A SLIDING DOOR

BACKGROUND OF THE INVENTION

1. Field of the Invention

The present invention relates to an auto-closing device, and more particularly to an auto-closing device for a sliding door to provide an adjustable spring pulling force applied to the sliding door.

2. Description of Related Art

A sliding door panel always has an auto-closing device having a buffering effect to pull the sliding door panel to an original position. A conventional auto-closing device has a spring, a buffering cylinder and a moving element connected to the spring and the buffering cylinder. The moving element can clamp a connection rod mounted on the door panel and moves with the door panel to an opened or a closed condition. The spring provides a pulling force to the door panel to move the door panel to an original position. The buffering cylinder provides a buffering effect to the door panel to prevent the door panel bumping with a door frame and to cause the damage to the door panel.

However, the pulling force provided by the spring of the conventional auto-closing device is not adjustable and is constant, the conventional auto-closing device cannot be applied to different door panels with different weights. When the conventional auto-closing device is applied to a door panel having a light weight, the pulling force provided by the spring is too large to pull the door panel. Thus, the moving speed of the door panel is increased to cause a large bumping force applied to the door panel. In addition, a large force is necessary for a user to open or to close the door panel for overcoming the pulling force of the spring, the conventional auto-closing device is inconvenient in use. When the conventional auto-closing device is applied to a door panel having a heavy weight, the pulling force provided by the spring is not sufficient to move the door panel to the original position.

To overcome the shortcomings, the present invention tends to provide an auto-closing device to mitigate or obviate the aforementioned problems.

SUMMARY OF THE INVENTION

The main objective of the invention is to provide an auto-closing device for a sliding door to provide an adjustable pulling force.

The auto-closing device comprises a base, a cylinder, a slider, a spring and an adjusting device. The base has a chamber defined in the base, a track channel and at least one guiding channel. The track channel is defined in an outer surface of the base and communicates with the chamber. The at least one guiding channel is defined in the base and communicates with the chamber. Each guiding channel has an end provided with a positioning recess. The cylinder is mounted in the chamber of the base and comprises a housing and an expansion rod retractably mounted on the housing. The slider is mounted slidably in the chamber along the track channel, extends out from the base via the track channel, is connected to the expansion rod of the cylinder and comprises a positioning pin. The positioning pin is mounted on the slider, is mounted slidably in the at least one guiding channel in the base and selectively engages the positioning recess in the at least one guiding channel. The spring has an end connected with the slider. The adjusting device is connected to an end of the spring opposite to the slider and has an adjusting frame and an adjusting bolt. The adjusting frame has a first end connected securely to the spring and a second end provided with a threaded hole. The adjusting bolt is mounted rotatably on the base and is screwed into the threaded hole in the adjusting frame.

Other objects, advantages and novel features of the invention will become more apparent from the following detailed description when taken in conjunction with the accompanying drawings.

DETAILED DESCRIPTION OF PREFERRED EMBODIMENT

Figure 1:
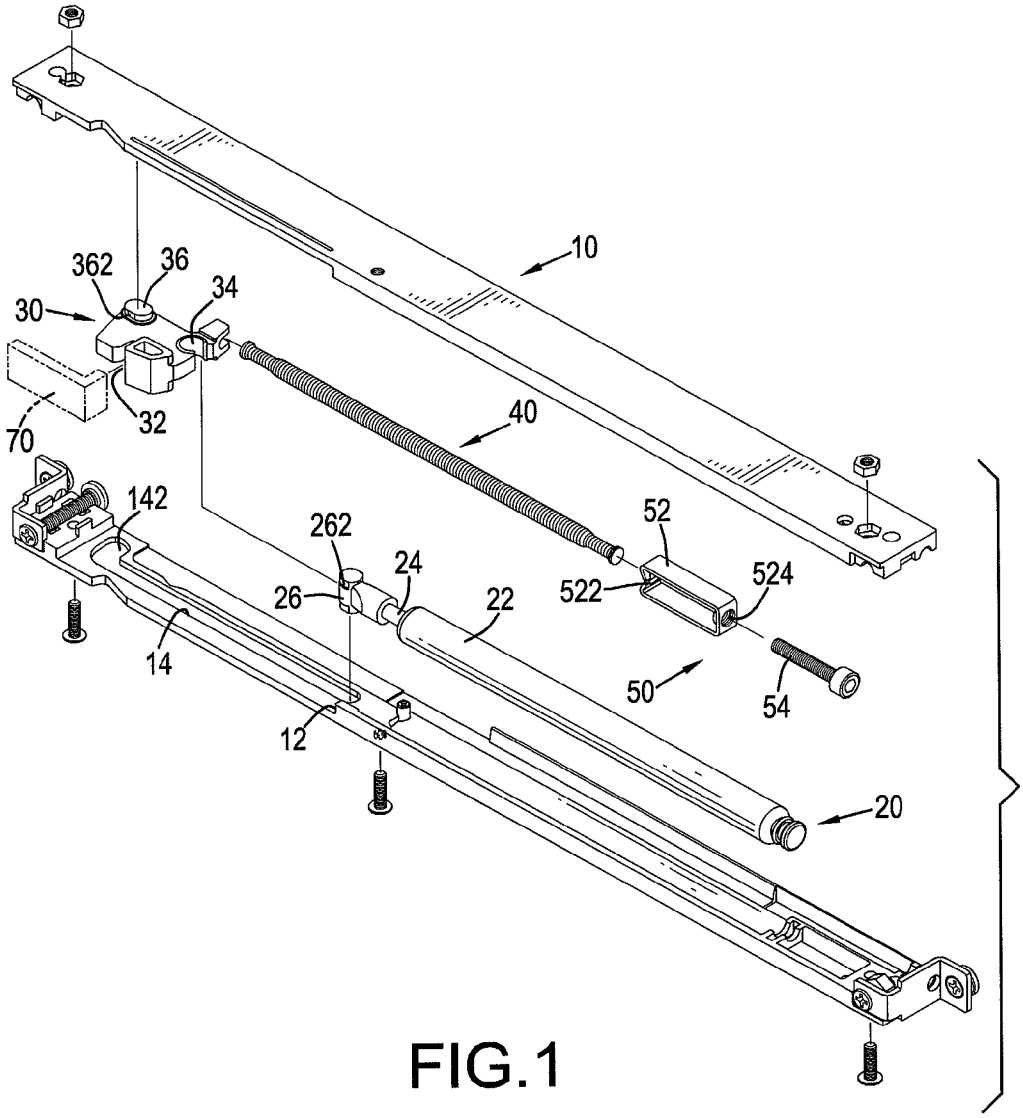
FIG. 1 is an exploded perspective view of an auto-closing device in accordance with the present invention.
Figure 2:
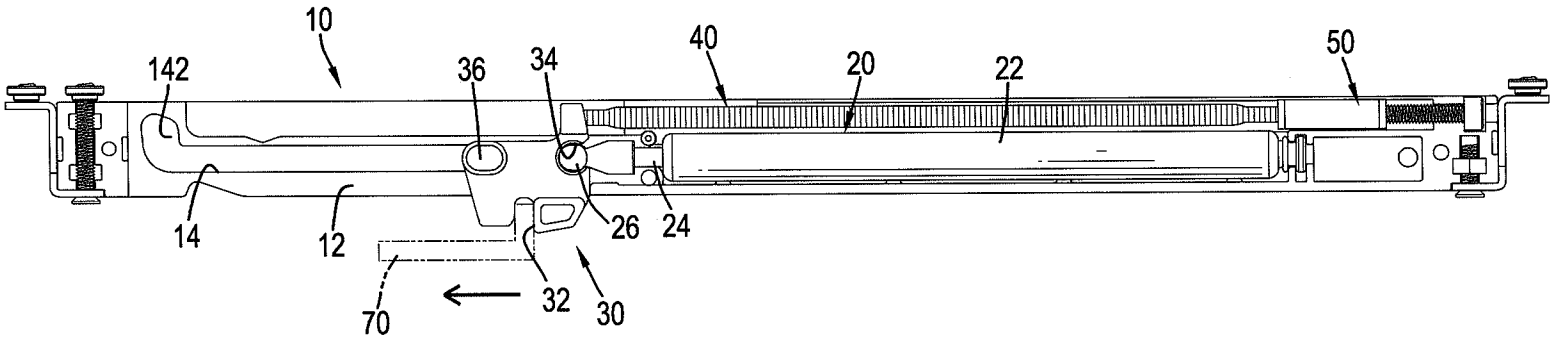
FIG. 2 is an operational top view of the auto-closing device in FIG. 1 with the cover being removed and showing a door panel being moved away from an original position.
Figure 3:
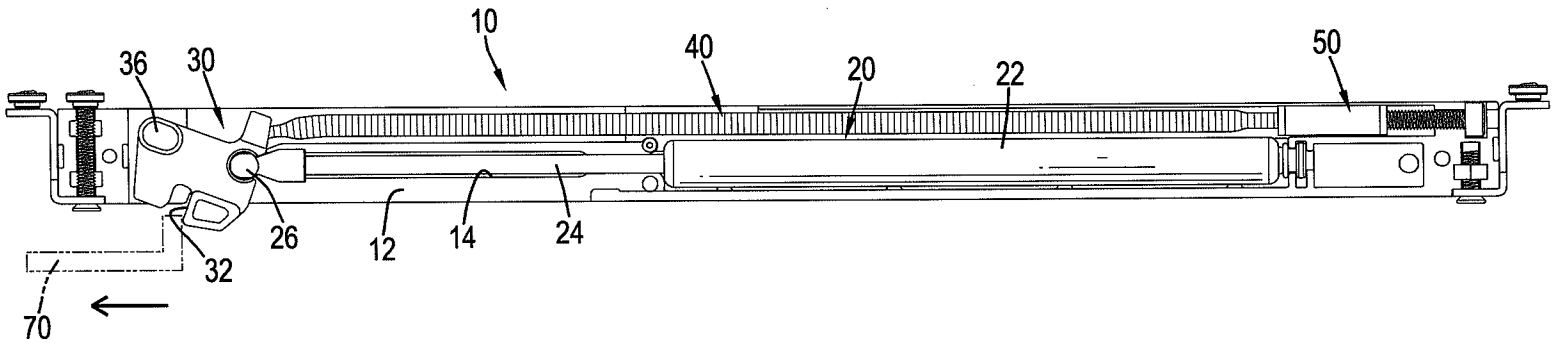
FIG. 3 is an operational top view of the auto-closing device in FIG. 1 with the cover being removed and showing a door panel being further moved away from the original position.

With reference to FIGS. 1 to 3, an auto-closing device for a sliding door in accordance with the present invention comprises a base 10, a cylinder 20, a slider 30, a spring 40 and an adjusting device 50.

The base 10 is securely mounted on a rail of a sliding door, may be elongated, is hollow and has a chamber, a track channel 12 and at least one guiding channel 14. Preferably, the base 10 is composed of a body and a cover. The chamber is defined in the base 10. The track channel 12 is defined longitudinally in the outer surface of the base 10 and communicates with the chamber. The at least one guiding channel 14 is defined longitudinally in the base 10 and communicates with the chamber. Preferably, the base 10 has two guiding channels 14 aligning with each other and defined respectively in two corresponding inner surfaces of the base 10. Each guiding channel 14 has an end provided with a positioning recess 142.

The cylinder 20 may be a hydraulic or pneumatic cylinder, is mounted in the chamber of the base 10 and comprises a housing 22 and an expansion rod 24. The housing 22 contains hydraulic or pneumatic pressure inside. The expansion rod 24 is retractably mounted on and extends out from the housing 22. With the pressure in the housing 22, a damping and resistance force is applied to the expansion rod 24 when the expansion rod 24 is expanded from or retracted into the housing 22.

Figure 7:
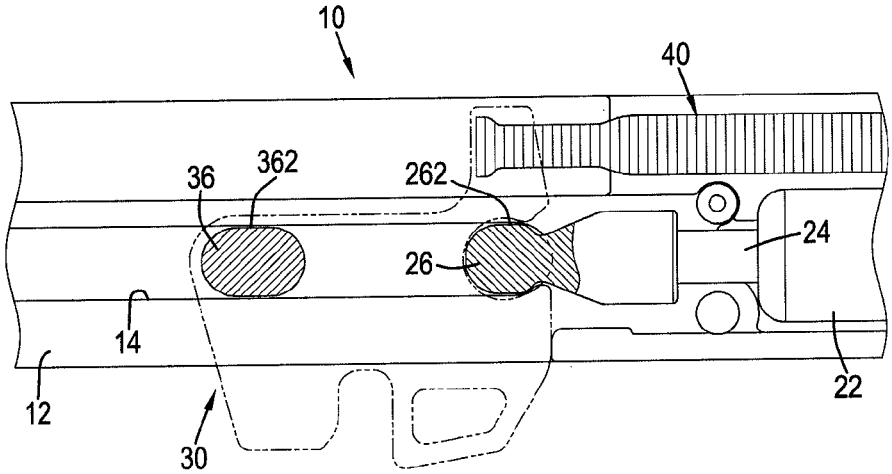
FIG. 7 is an enlarged top view in partial section of the auto-closing device in FIG. 1 with the cover being removed.

The slider 30 is mounted slidably in the chamber along the track channel 12, extends out from the base 10 via the track channel 12, is connected to the expansion rod 24 and comprises a holding recess 32, a connection portion 34 and a positioning pin 36. The holding recess 32 is defined in a side edge of the slider 30 that extends out of the track channel 12, engages a connecting member 70 that is mounted on a door panel. With the engagement between the holding recess 32 and the connecting member 70, the slider 30 can be moved with the door panel along the track channel 12 while the door panel is moving. The connection portion 34 is defined on one end of the slider 30 and is connected to the expansion rod 24 of the cylinder 20. The connection portion 34 may be a concave cavity, and a pivotal pin 26 is mounted on one end of the expansion rod 24 and is mounted rotatably in connection portion 34. The pivotal pin 26 has an axial length larger than the thickness of the slider 30, such that at least one end of the pivotal pin 26 protrudes out of at least one of two side faces of the slider 30 and is respectively mounted slidably in the at least one guiding channel 14 in the base 10. With further reference to FIG. 7, the pivotal rod 26 has two flats defined in each end of the pivotal rod 26 that is mounted in a corresponding one of the guiding channels 14 and abutting the inner surface of the guiding channel 14. With the abutments between the flats on the pivotal rod 26 and the inner surfaces of the guiding channels 14, gaps formed between the pivotal rod 26 and the guiding channel 14 due to the wearing can be prevented from occurring. The movement of slider 30 is smooth and stable.

The positioning pin 36 is mounted on an end of the slider 30 opposite to the connection portion 34, is mounted slidably in the guiding channels 14 and is selectively mounted in the positioning recesses 142 in the guiding channels 14. Preferably, one end or both two ends of the positioning pin 36 is/are mounted respectively in the guiding channels 14, and each end of the positioning pin 36 that is mounted in a corresponding one of the guiding channels 14 has two flats 362 abutting with the inner surface of the corresponding guiding channel 14. With the abutments between the flats 362 on the positioning pin 36 and the inner surfaces of the guiding channels 14, the movement of slider 30 is smooth and stable.

The spring 40 is mounted in the chamber and has two ends connected respectively with the base 10 and the slider 30. One end of the spring 40 is connected to the slider 30 and the other end of the spring 40 is connected to the adjusting device 50.

The adjusting device 50 is mounted on the base 10, is connected to one end of the spring 40 and comprises an adjusting frame 52 and an adjusting bolt 54. The adjusting frame 52 is hollow and has a first end and a second end. The first end of the adjusting frame 52 is connected securely to the spring 40 and has a securing hole 522 defined in the first end of the adjusting frame 52 and engaging one end of the spring 40. The second end of the adjusting frame 52 is opposite to the spring 40 and has a threaded hole 524 defined through the second end of the adjusting frame 52. The adjusting bolt 54 is mounted rotatably on one end of the base 10 and is screwed with the threaded hole 524 in the adjusting frame. Consequently, when the adjusting bolt 54 is rotated, the adjusting frame 52 will be moved relative to the base 10 due to the threaded engagement between the adjusting bolt 54 and the threaded hole 524. Accordingly, the spring 40 can be expanded or released, and the pulling force provided by the spring 40 can be adjusted.

With reference to FIGS. 2, 3 and 7, when the door panel is moved away from an original position, such as a completely opened or a closed position, the slider 30 will be moved along the track channel 12 due to the engagement between the holding recess 32 and the connecting member 70. With the movement of the slider 30, the pivotal rod 26 on the expansion rod 24 of the cylinder 20 and the positioning pin 36 will also move along the guiding channels 14. Thus, the spring 40 is stretched and the expansion rod 24 is expended out from the housing 22. When the positioning pin 36 moves into the positioning recesses 142 in the ends of the guiding channels 14, the slider 30 will be pivoted relative to the expansion rod 24 and become oblique relative to the base 10. Accordingly, the connecting member 70 will disengage from the holding recess 32, and the door panel can keep moving away from the original position. Therefore, the length of the track channel 12 or the guiding channels 14 does not limit the travel of the door panel.

Figure 4:
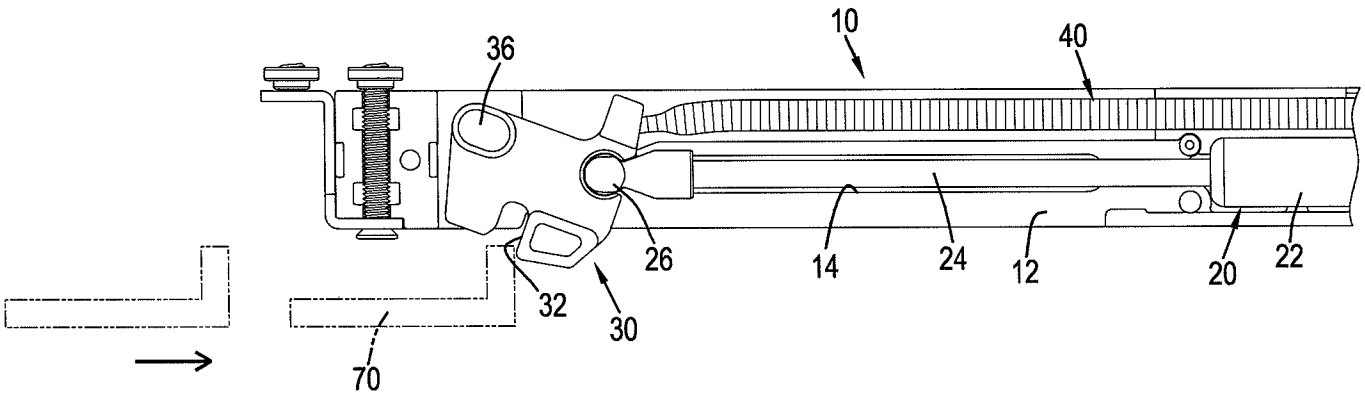
FIG. 4 is an enlarged operational top view of the auto-closing device in FIG. 1 with the cover being removed and showing the door panel being moved to the original position by the auto-closing device.

When the door panel is moved to the original position by power, with reference to FIGS. 1 and 4, the connecting member 70 will enter into the holding recess 32 and push against the inclined slider 30. Consequently, the slider 30 can be pivoted to engage the connecting member 70 in the holding recess 32, such that the slider 30 can be moved along the track channel 12 with the door panel to the original position. With the slider 30 moving toward the original position of the door panel, the expansion rod 24 can be retracted into the housing 22, and the hydraulic or pneumatic pressure in the housing 22 can provide the expansion rod 24 a damping and resistance force. Accordingly, the moving speeds of the door panel and the slider 30 can be slowed down, and the door panel can be kept from bumping against the doorframe or the wall at a high speed. Therefore, a buffering effect is provided to the door panel to prevent the door panel, the doorframe or the wall from being damaged. With the pulling force provided by the spring 40, the door panel can be ensured to move back to the original position actually, such as a completely closed or opened position.

Figure 5:
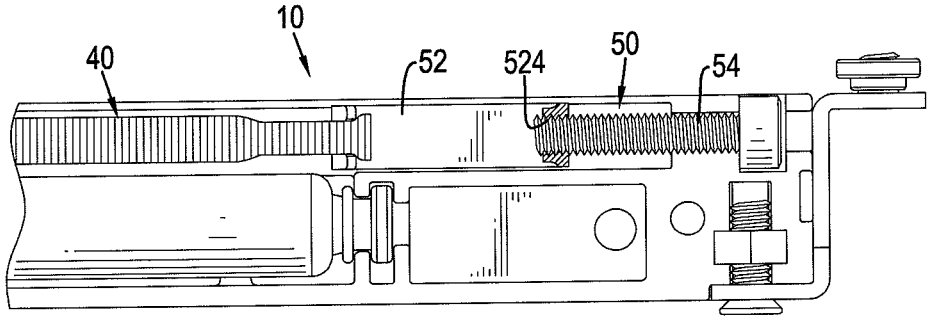
FIG. 5 is an enlarged top view of the auto-closing device in FIG. 1 with the cover being removed.
Figure 6:
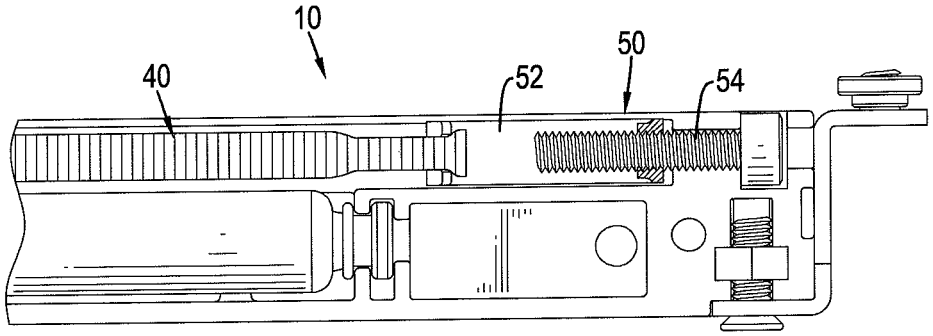
FIG. 6 is an enlarged operational top view of the auto-closing device in FIG. 1 with the cover being removed and showing the pulling force provided by the spring being adjusted.

To fit with different door panels having different weights, with reference to FIGS. 5 and 6, the adjusting bolt 54 is rotated to move the adjusting frame 52 relative to the base 10. Consequently, the spring 40 can be pre-expanded and the pulling force provided by the spring 40 is adjusted. Accordingly, the pulling force of the spring 40 can be adjusted based on the weights of the door panels to prevent the pulling force of the spring 40 from being too small or large for pulling the door panel. Thus, the auto-closing device in accordance with the present invention is convenient and versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An auto-closing device for a sliding door comprising:

a base having a chamber defined in the base;

a track channel defined in an outer surface of the base and communicating with the chamber; and at least one guiding channel defined in the base and communicating with the chamber, and each one of the at least one guiding channel having an end provided with a positioning recess;

a linear damper mounted in the chamber of the base and comprising a housing; and an expansion rod retractably mounted on the housing;

a slider mounted slidably in the chamber along the track channel, extending out from the base via the track channel, connected to the expansion rod of the linear damper and comprising a holding recess for receiving a portion of said sliding door; and a positioning pin mounted on the slider, mounted slidably in the at least one guiding channel in the base and selectively engaging the positioning recess of the at least one guiding channel;

a spring having an end connected with the slider; and an adjusting device connected to an end of the spring opposite to the slider and having an adjusting frame having a first end connected securely to the spring and a second end provided with a threaded hole; and an adjusting bolt mounted rotatably on the base and screwed into the threaded hole in the adjusting frame wherein the adjusting frame is hollow and has a securing hole defined in the first end of the adjusting frame and engaging an end of the spring opposite the slider.

2. The auto-closing device as claimed in claim 1, wherein the base has two guiding channels aligning with each other.

3. The auto-closing device as claimed in claim 2, wherein the two guiding channels are defined respectively in two corresponding inner surfaces of the base.

4. The auto-closing device as claimed in claim 3, wherein the slider has a connection portion formed on one end of the slider and connected to the expansion rod of the linear damper;

the connection portion is a concave cavity; and a pivotal pin is mounted on one end of the expansion rod and is mounted rotatably in the connection portion.

5. The auto-closing device as claimed in claim 4, wherein the pivotal pin has an axial length larger than the thickness of the slider, and two ends of the pivotal pin protrude out of two side faces of the slider and are respectively mounted slidably in the guiding channels; and each end of the pivotal pin has two flats defined in the end of the pivotal pin and abutting an inner surface of a corresponding one of the guiding channels.

6. The auto-closing device as claimed in claim 5, wherein the positioning pin is mounted on an end of the slider opposite to the linear damper.

7. The auto-closing device as claimed in claim 6, wherein the positioning pin has two ends each mounted in a corresponding one of the guiding channels and each having two flats abutting with an inner surface of the corresponding guiding channel.

8. The auto-closing device as claimed in claim 1, wherein the at least one guiding channel is defined in an inner surface of the base.

9. The auto-closing device as claimed in claim 1, wherein the slider has a connection portion formed on one end of the slider and connected to the expansion rod of the linear damper;

the connection portion is a concave cavity; and a pivotal pin is mounted on one end of the expansion rod and is mounted rotatably in the connection portion.

10. The auto-closing device as claimed in claim 9, wherein the pivotal pin has an axial length larger than the thickness of the slider, and at least one end of the pivotal pin protrude out of at least one of two side faces of the slider and is respectively mounted slidably in the at least one guiding channel; and each one of the at least one end of the pivotal pin that is mounted in a corresponding one of the at least one guiding channel has two flats defined in the end of the pivotal pin and abutting an inner surface of the corresponding one of the at least one guiding channel.

11. The auto-closing device as claimed in claim 1, wherein the positioning pin is mounted on an end of the slider opposite to the linear damper.

12. The auto-closing device as claimed in claim 11, wherein the positioning pin has an end mounted in one of the at least one guiding channel and having two flats abutting with an inner surface of the corresponding guiding channel.

* * * * *